United States Patent [19]

Gould

[11] 4,071,833

[45] Jan. 31, 1978

[54] APPARATUS FOR COUPLING COAXIAL TRANSMISSION LINE TO RECTANGULAR WAVEGUIDE

[75] Inventor: Harry J. Gould, Cupertino, Calif.

[73] Assignee: Ford Motor Company, Dearborn, Mich.

[21] Appl. No.: 732,688

[22] Filed: Oct. 15, 1976

[51] Int. Cl.[2] ..... H01P 5/08

[52] U.S. Cl. ..... 333/33; 333/97 R

[58] Field of Search ..... 333/21 R, 33

[56] References Cited

U.S. PATENT DOCUMENTS

| | | | |
|---|---|---|---|
| 3,375,474 | 3/1968 | Thompson et al. | 333/21 R |
| 3,758,886 | 9/1973 | Landry et al. | 333/21 R X |
| 3,942,138 | 3/1976 | Schaedla | 333/21 R |

*Primary Examiner*—Paul L. Gensler

*Attorney, Agent, or Firm*—Robert W. Brown; Keith L. Zerschling

[57] ABSTRACT

Improved apparatus for coupling microwave energy from coaxial transmission line to rectangular waveguide and vice versa. A cover, which includes a conductive material, is positioned on one end of a rectangular waveguide. The cover has an opening for receiving the center conductor of a coaxial transmission line and has means for electrically connecting the outer conductor of the coaxial transmission line to the conductive material of the cover. A conductive mass is positioned within the waveguide in spaced relation with its walls and the cover. The center conductor of the coaxial transmission line is in electrically conductive relation with the conductive mass. A hook-shaped conductive element has one of its ends in electrically conductive relation with the conductive mass and has its other end terminating within the waveguide at a location spaced from the waveguide walls and the cover. The conductive mass is located between the cover and the hook-shaped element, and the curvature of the hook-shaped element preferably is in a plane parallel to the narrow walls of the waveguide and off-set from its axis parallel to these narrow walls. Preferably the ends of the hook-shaped element are substantially equally spaced from the wide walls of the waveguide.

6 Claims, 3 Drawing Figures

APPARATUS FOR COUPLING COAXIAL TRANSMISSION LINE TO RECTANGULAR WAVEGUIDE

BACKGROUND OF THE INVENTION

This invention relates to improved apparatus for coupling microwave energy from a coaxial transmission line to a rectangular waveguide and vice versa.

Various coaxial-to-waveguide transitions are known in the prior art. The function of such transitions is to couple microwave energy from the coaxial line to the waveguide and vice versa, but it is desired to accomplish this function in a manner that minimizes the reflected microwave energy resulting from the transition. In other words, an impedance transformer is required at the coaxial to waveguide transition to minimize the standing wave ratio and reflected energy or return loss in the transmission line. Moreover, it is desirable that this minimization be effective over a wide frequency band. The "conventional" coaxial-to-waveguide transition comprises a waveguide having a closed end and a coaxial line connection mounted in one of the wide walls of the waveguide so that the coaxial line center conductor enters the waveguide in its E-plane. Coaxial lines that enter the waveguide from one of its ends also are known. The center conductor contacts one of a series of progressively larger blocks mounted in the waveguide as an impedance transformer. The conventional and other transitions are described or illustrated in the following publications: Gershon J. Wheeler, "Broadband Waveguide-to-Coax Transitions," *IRE National Convention Record* (Part 1), pp. 182–185, Mar. 18–21, 1957; Chao Chun Chen et als, "Ultra-Wideband Phased Arrays," Hughes Aircraft Company Contract Report to the Air Force Cambridge Research Laboratories, AFCRL-TR-73-0569, pp. 2–18 to 2–24, July, 1973; and J. C. Dix, "Design of Waveguide/Coaxial Transition for the Band 2.5–4.1 GHz," *Proceedings of the IEEE,* Vol. 110, pp. 253–255, February 1963.

SUMMARY OF THE INVENTION

The present invention provides improved apparatus for coupling microwave energy from a coaxial transmission line to a rectangular waveguide through the end of the waveguide and vice versa. The coaxial transmission line is connected to a cover positioned on one of the ends of the waveguide, which permits a plurality of such waveguides to be clustered together to form a multiple waveguide element array that may be used as an antenna for transmitting into, or receiving from, free space microwave energy.

The cover on the end of the waveguide includes an electrically conductive material. An opening in the cover is provided for receiving the center conductor of a coaxial transmission line. A conductive mass, which preferably is a brass block constituting a lumped capacitance, is mounted within the waveguide in spaced relation with its walls and the cover. The coaxial line center conductor is in electrically conductive relation with the conductive mass. A hook-shaped conductive element has first and second ends. The first end is in electrically conductive relation with the conductive mass, which preferably thereby supports the hook-shaped element. The second end of this element is in spaced relation with the waveguide walls and cover and is insulated therefrom. The curvature of the hook-shaped element is in a plane parallel to the waveguide axis that is parallel to its narrow walls. Preferably this plane is located between the axis and one of the narrow walls. The ends of the hook-shaped element may be substantially equally spaced from the wide walls of the waveguide.

The invention has been found to substantially reduce losses due to reflected energy, as compared to other transitions wherein the coaxial line is connected to a cover on one end of a waveguide, over a wide band of microwave frequencies. A better understanding of the invention may be obtained by reference to the detailed description which follows and to the drawings.

BRIEF DESCRIPTION OF THE DRAWINGS

FIG. 3 is a graph of the return loss of the apparatus of FIGS. 1 and 2 versus frequency in the microwave region.

DETAILED DESCRIPTION

Figure 1:
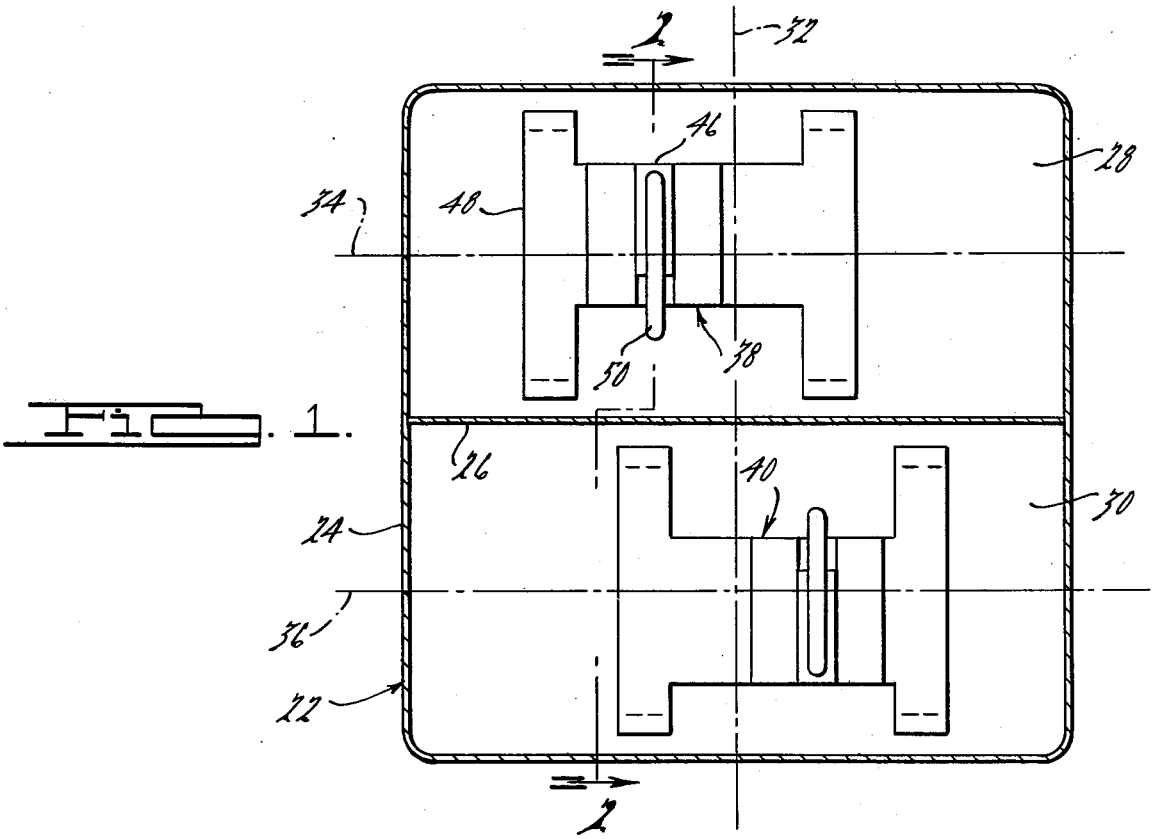
FIG. 1 is an enlarged sectional view of a square waveguide having a central portion dividing the square waveguide into two equal-size rectangular waveguides and includes two coaxial-to-rectangular waveguide transitions.
Figure 2:
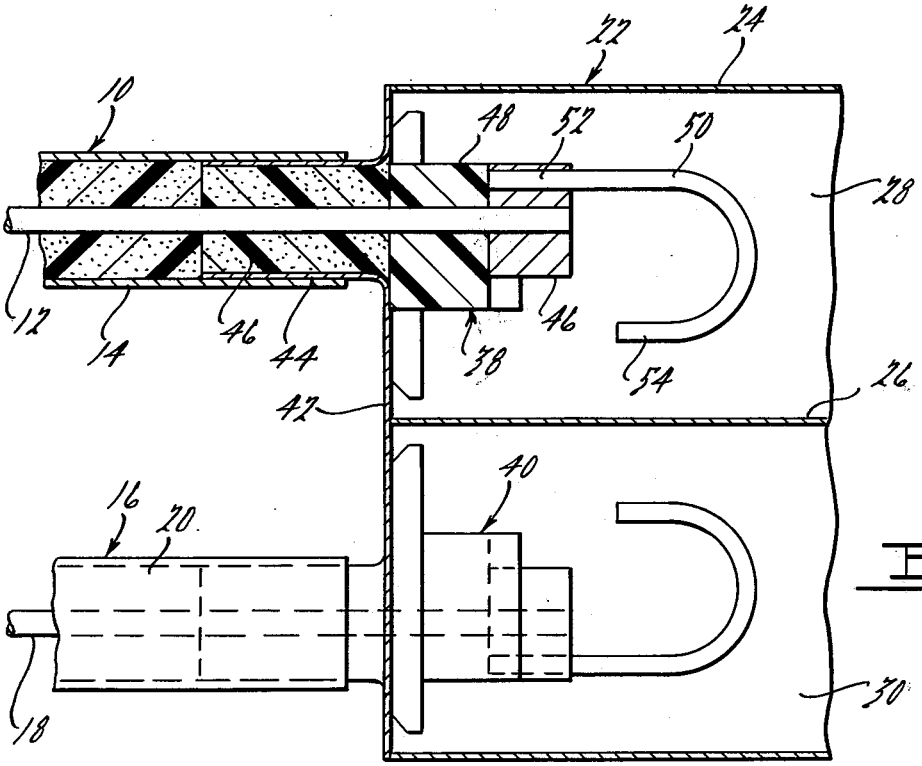
FIG. 2 is an enlarged sectional view of the apparatus of FIG. 1, the section being taken along the line 2—2 in FIG. 1.
Figure 2:
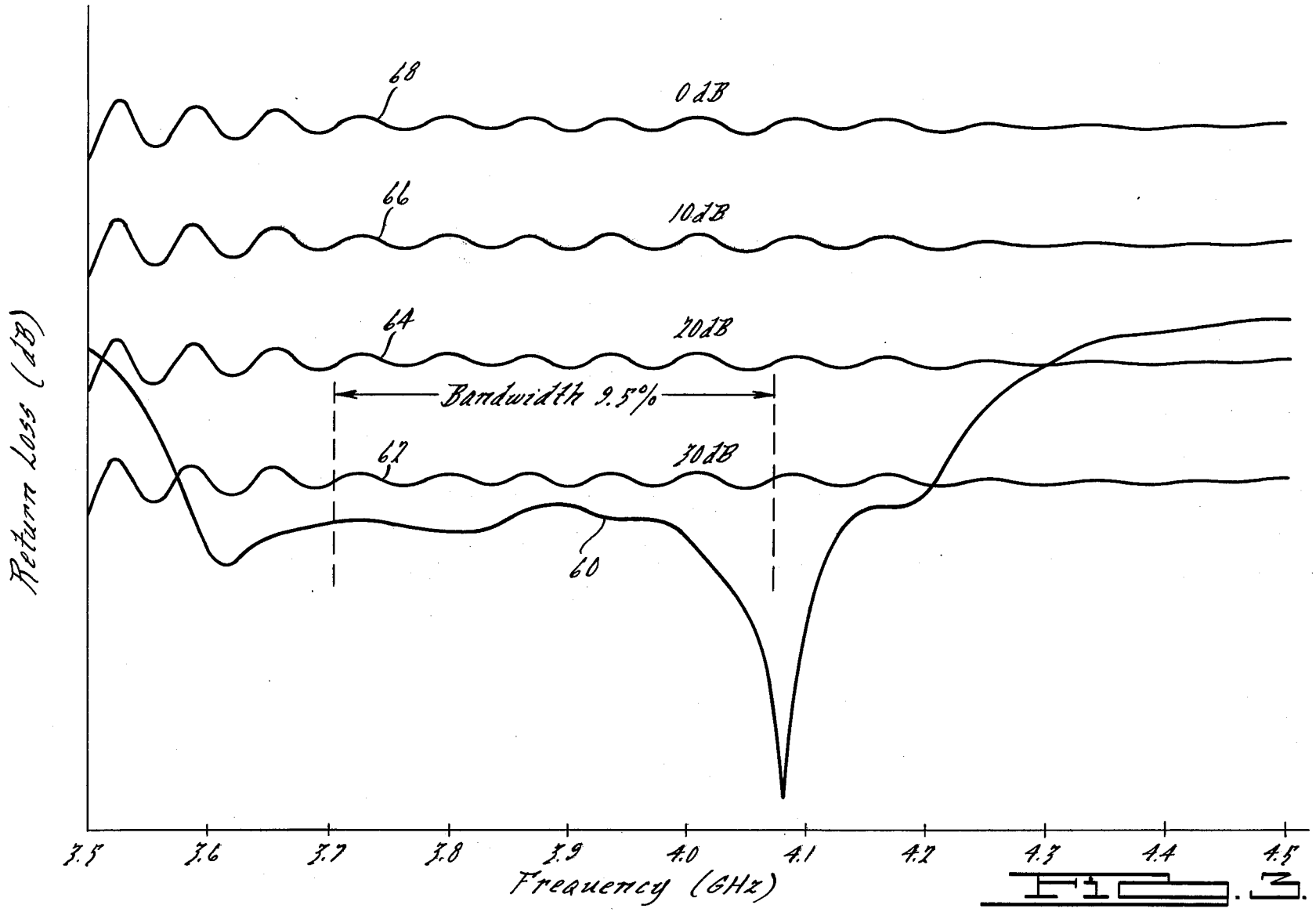

With reference now to the drawings, wherein like numerals refer to like parts in the several views, there is shown a coaxial transmission line 10 having a center conductor 12 and an outer conductor 14. A second coaxial transmission line 16 has a center conductor 18 and an outer conductor 20.

The improved apparatus of the invention for coupling microwave energy from coaxial transmission line to waveguide and vice versa is generally designated by the numeral 22. The coupler 22 includes a square waveguide 24 having a septum 26 that divides the square waveguide into two equal-sized rectangular waveguides 28 and 30. The septum 26 is a wide wall common to both of the rectangular waveguides and the walls of the waveguide 24 that are perpendicular to the septum form the narrow walls of waveguides 28 and 30. The dot-dash line 32 defines a first axis for both of the rectangular waveguides that is parallel to their narrow walls. Dot-dash lines 34 and 36, respectively, are axes of the rectangular waveguides 28 and 30 that are parallel to their wide walls. Axes 32, 34 and 36 are all perpendicular to the direction of propagation of microwave energy through the rectangular waveguides.

The septum 26, at a location in the waveguide 24 more remote from the coaxial lines 10 and 16 than is illustrated in the drawings, may be tapered or shaped in a manner that permits linearly polarized microwave signals in rectangular waveguides 28 and 30 to be transformed to right-hand and left-hand circularly polarized microwave signals in the square waveguide 24 and vice versa. A septum that performs this function in a square waveguide having two rectangular waveguide ports is described in U.S. Pat. No. 3,958,193 issued May 18, 1976, to James V. Rootsey. However, a preferred septum in a square waveguide designed to accomplish this function is described in my co-pending and commonly assigned U.S. patent application, Ser. No. 808,206 filed June 20, 1977 and entitled, "Balanced Phase Septum Polarizer." Preferably, the septum 26 is arranged such that a linearly, polarized microwave signal from coaxial line 10 is introduced into the rectangular waveguide 28 and thereafter transformed into a right-hand circularly polarized (RHCP) microwave signal in the square waveguide 24, and a linearly polarized microwave signal from coaxial line 16 is introduced into the rectangular waveguide 30 and thereafter transformed to a left-hand circularly polarized (LHCP) microwave signal in the square waveguide 24.

The coupler 22 actually includes two couplers, generally designated by the numerals 38 and 40, for coupling microwave signals on the coaxial lines 10 and 16 into the rectangular waveguides 28 and 30, respectively, and vice versa. Only the coupler 38 is described herein in detail. The coupler 40 is identical, and the couplers need not be used together as shown in the drawings, but may be used separately.

The waveguide 24 has a cover 42 over one of its ends. This cover has a protruding portion 44 that defines an opening, which may be filled with a suitable dielectric material 46, for receiving the center conductor 12 of the coaxial transmission line 10. The protruding portion 44 and the remainder of the cover 42 includes an electrically conductive material. It and the square waveguide may be made entirely of copper or other suitable conductive material or may be made from fiber reinforced carbon having an electroformed copper or other high conductivity material on its internal surfaces. The outer conductor 14 of the coaxial line 10 is in electrically conductive relation with the cover 42 at its protruding portion 44.

The center conductor 12 of the coaxial line 10 passes through the cover 42 and is received by, and in electrically conductive relation with, a conductive mass 46 that is located within the rectangular waveguide 28 in spaced relation to its walls and the cover 42. The conductive mass 46 preferably is a brass block in the shape of a rectangular solid. It constitutes a lumped capacitance in the coupler 38 and has a centrally located opening that receives center conductor 12. A dielectric support member 48 locates the block or conductive mass 46. A hook-shaped element 50 has a first end 52 that is received in an opening in the conductive mass and is in electrically conductive relation therewith. The second end 54 of the hook-shaped element 50 is in spaced relation to the conductive material of the waveguide 28 walls and its cover 42. The hook-shaped element 50 preferably has a uniform radius that produces a 180° directional change in the round conductive wire from which it is formed. However, a smooth curvature of the hook portion is not essential; sharp bends or even square corners could be used to form the curvature, but to achieve the high level performance of the illustrated embodiment dimensional or shape or location changes to the coupler elements may then be required.

The curvature of the hook-shaped element 50 preferably is in a plane parallel to the axis 32 and the narrow walls of rectangular waveguide 28, and preferably this plane is located between the axis 32 and one of the narrow walls, as is illustrated in the drawings. The illustrated location of the element 50 provides coupler impedance matching over a much broader band of microwave frequencies than can be achieved with prior art end fed coaxial line-to-waveguide transitions. It should be noted that the ends 52 and 54 of the hook-shaped element 50 are substantially equally spaced from the adjacent wide walls of the rectangular waveguide 28. This is desirable, but not essential. Also, in contrast to prior art couplers, the end 54 of the element 50 is not in electrically conductive relation with any of the waveguide walls. Most or all prior art couplers have had the coaxial line center conductor enter the waveguide and then, perhaps through an impedance matching stepped conductive block, have had this center conductor in electrically conductive relation with one of the wide walls of the waveguide.

The illustrated couplers 38 and 40 are intended for use in the frequency band from 5.7 to 6.3 GHz. The dimensions of the various coupler elements and their spacing relative to the waveguide walls and relative to the cover 42 are selected to minimize the voltage standing wave ratio and power return loss over this frequency band. As illustrated, the internal wall dimension of the square waveguide 24 is 1.207 inches and the septum 26 has a thickness of about ten-thousandths of an inch. A maximum voltage standing wave ratio of 1.07 has been achieved over this band with the illustrated coupler design.

FIG. 3 illustrates the response of a coaxial-to-rectangular waveguide coupler constructed in accordance with the invention for the frequency band from 3.7 to 4.08 GHz (about 9.5% bandwidth). The return loss, in relative dB, is plotted against frequency. The return loss is calculated as 20 log $E_i/E_r$ where $E_i$ is the incident electric field of a test signal and $E_r$ is the reflected electric field. The curve 60 is the response of the inventive coupler. Curves 62, 64, 66 and 68 illustrate reference dB levels for the test signal over the frequency band from 3.5 to about 4.5 GHz. The curve 60 shows that the return loss is down more than 30 dB over a band from about 3.6 to 4.2 GHz.

Based upon the foregoing description of the invention, what is claimed is:

1. In combination with a coaxial transmission line, having an outer conductor and a center conductor, and a rectangular waveguide, having a first axis parallel to the narrow sides of said waveguide and a second axis parallel to the wide sides of said waveguide, said first and second axes being mutually perpendicular and perpendicular to the direction of propagation of microwave energy through said waveguide, an improved apparatus for coupling microwave energy from said coaxial transmission line to said waveguide and vice versa, said improved apparatus comprising:

a. a cover on one end of said waveguide, said cover including a conductive material and having an opening for receiving said center conductor of said coaxial transmission line and having means for conductively connecting said outer conductor of said coaxial transmission line to said conductive material of said cover;

b. a conductive mass positioned within said waveguide, said conductive mass being spaced from the walls of said waveguide and from said cover, said center conductor of said coaxial transmission line being in electrically conductive relation with said conductive mass; and c. a hook-shaped conductive element having first and second ends, said first end being in electrically conductive relation with said conductive mass, said second end terminating within said waveguide at a location spaced from the walls thereof and at a location spaced from said cover, said hook-shaped conductive element having a curvature between its first and second ends that is in a plane that is parallel with said first axis of said waveguide.

2. Apparatus according to claim 1 wherein said first and second ends of said hook-shaped conductive element are substantially equally spaced from the wide walls of said waveguide.

3. Apparatus according to claim 1 wherein said conductive mass is located between said cover and said curvature of said hook-shaped element.

4. Apparatus according to claim 1 wherein said plane in which said curvature of said hook-shaped element is located is a plane parallel to and between said first axis and one of the narrow walls of said waveguide.

5. Apparatus according to claim 4 wherein said conductive mass is located between said cover and said curvature of said hook-shaped element.

6. Apparatus according to claim 5 wherein said first and second ends of said hook-shaped conductive element are substantially equally spaced from the wide walls of said waveguide.

* * * * *